US005168683A

United States Patent [19]

Sansom et al.

[11] Patent Number: 5,168,683

[45] Date of Patent: Dec. 8, 1992

[54] JOINT MEMBER AND/OR A METHOD OF FORMING A JOINT

[75] Inventors: Ernest P. Sansom, 141 Drakei Road, Remuera; Albert K. Lewis, 102 Arney Road, Remuera; Timoty Le Couteur, all of Auckland, New Zealand

[73] Assignees: E. P. Sansom; A. K. Lewis, both of Auckland, New Zealand

[21] Appl. No.: 523,815

[22] Filed: May 16, 1990

[30] Foreign Application Priority Data

May 17, 1989 [NZ] New Zealand ..... 229154

[51] Int. Cl.[5] ..... E01C 11/10

[52] U.S. Cl. ..... 52/396; 52/403; 404/68

[58] Field of Search ..... 52/396, 403; 404/67, 404/68, 69

[56] References Cited

U.S. PATENT DOCUMENTS

| | | | |
|---|---|---|---|
| 2,405,844 | 8/1946 | Mortenson | 52/396 |
| 4,290,249 | 9/1981 | Mass | 52/403 |
| 4,362,427 | 12/1982 | Mass et al. | 52/396 |

FOREIGN PATENT DOCUMENTS

| | | | |
|---|---|---|---|
| 678685 | 1/1964 | Canada | 52/403 |
| 0152367 | of 0000 | European Pat. Off. . | |
| 1409845 | 10/1968 | Fed. Rep. of Germany | 404/69 |
| 1192335 | of 0000 | United Kingdom . | |
| 1339643 | of 0000 | United Kingdom . | |
| 1478963 | of 0000 | United Kingdom . | |
| 1481410 | of 0000 | United Kingdom . | |

*Primary Examiner*—Richard E. Chilcot, Jr.
*Assistant Examiner*—Joanne C. Downs
*Attorney, Agent, or Firm*—Jacobson, Price, Holman & Stern

[57] ABSTRACT

A joint member (1) is substantially elongated and has a stabilizing parts (2, 3) which retain the joint member in a desired orientation in use. Seal members (6, 7) are provided on the joint member and engage sides of an aperture into which the joint member (1) is positioned. The joint member includes an insertion part (5, 8), or divider plate, which enables the seal members (6, 7) to be placed in a desired position in use. The method of providing a nosing on edge faces of cementitious members includes positioning the divider plate (5) between the edge faces and inserting settable material (14, 15) between the elongated divider plate (5, 8) and the edge faces, then allowing the settable material to set.

35 Claims, 2 Drawing Sheets

JOINT MEMBER AND/OR A METHOD OF FORMING A JOINT

BACKGROUND OF THE INVENTION

This invention relates to a joint member and/or a method of forming a nosing. The joint system herein described can also be used as a nosing system and has been devised particularly though not necessarily solely for use in jointing operations in concrete floors.

Conventional industrial concrete floors require a joint system to initially control shrinkage and promote the resulting cracking to a predetermined grid system. These joints later act as temperature and movement control joints as well. At present, common methods of sealing these joints are to seal the joint with an elastomeric sealant with a movement capacity which is normally in the region of ±25%. Such a sealant properly placed can accommodate most normal temperature movements, however being elastomeric, the sealant is not hard enough to provide support to the concrete edge which then can suffer progressive damage from floor traffic. Alternatively the joint can be sealed with an epoxy type sealant with some flexibility. This solution gives support to the concrete edges, however in many instances the degree of flexibility of the sealant (±10%) is insufficient to cope with the joint movements experienced, and failure of the joint occurs by the sealant tearing away from the concrete. Again progressive damage then can occur from floor traffic. Thirdly the joint can be sealed with a mortar type filler which has no flexibility, and a low degree of adhesion. Movement creates a gap between the filler and the concrete edge and this edge is then prone to progressive damage from floor traffic.

Obviously each of these three systems has limitations 5 and disadvantages.

BRIEF SUMMARY OF THE INVENTION

It is therefore an object of the present invention to provide a joint member and/or a method of forming a joint which will obviate or minimize the foregoing disadvantages in a simple yet effective manner.

Accordingly in one aspect the invention is in a joint member positionable between cementitious faces comprising an upright divider plate, a base substantially wider in cross section than the divider plate, the divider plate being attached to the base, stabilization means able to retain the joint member in the desired orientation when the divider plate is positioned between the faces in use, and seal members formed from material substantially more resilient than the base and divider plate and able to engage the faces in use.

In a further aspect the invention is in a method of providing nosings along cementitious faces each having an upper edge including the steps of positioning and supporting an elongated divider plate between the faces, inserting settable material between the elongated divider plate and the faces, the settable material adhering to the faces but not to the divider plate when set, and allowing the settable material to set; the settable material having a high tensile strength and high compressive strength when set to protect the faces and upper edge from mechanical degradation in normal use.

In a further aspect the invention is in nosings provided along cementitious faces and adjacent an elongate divider plate provided between the faces, the faces having an upper edge, the nosing including set material provided between the divider plate and faces and having a high tensile strength and a high compressive strength to substantially protect the faces including the upper edge from mechanical degradation in normal use, the set material adhering to the faces but not to the divider plate.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings wherein.

DETAILED DESCRIPTION

Figure 1:
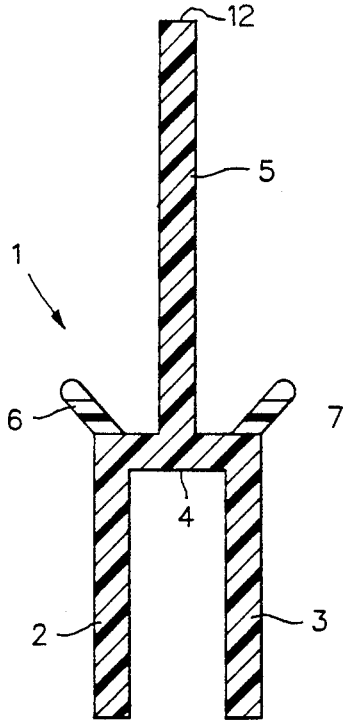
FIG. 1 is a transverse cross-sectional view of a joint member according to one preferred form of the invention.

Referring to the drawings a joint member and a method of forming a nosing are provided as follows.

A joint member 1 is formed which in the preferred form has stabilizing means so that in use the joint member is retained substantially in a desired orientation. The stabilizing members may comprise a pair of planar members or plates 2 and 3 which are spaced apart so that the distance between their outwardly facing faces is a little less than the width of a slot, channel, or groove into which the joint member 1 is to be placed in use. The plates 2 and 3 may be connected by a cross member 4 which may form the head of an inverted T-shaped member in the embodiment of FIG. 1 and 2 or the base to which a substantially rectangular inverted U-shaped member is attached in the embodiment of FIG. 3 and 4 in cross section. Insertion means are provided to enable the joint member to be placed into position in use. The insertion means may comprise a further divider plate member 5 lying in a parallel but displaced plane to the members 2 and 3 and which forms the stem or leg of the T-shaped member. Alternatively, the insertion means may comprise a substantially inverted U-shaped member, having an upper planar head 12' and downwardly extending planar members 8, which is substantially narrower horizontally than the base or head 4 to which it is attached. In this preferred form of the invention the inverted U-shaped member has weakened points 9 at which it is connected to the base or head 4. Thus the insertion means 8 can be removed once the joint member 1 is in position.

Figure 3:
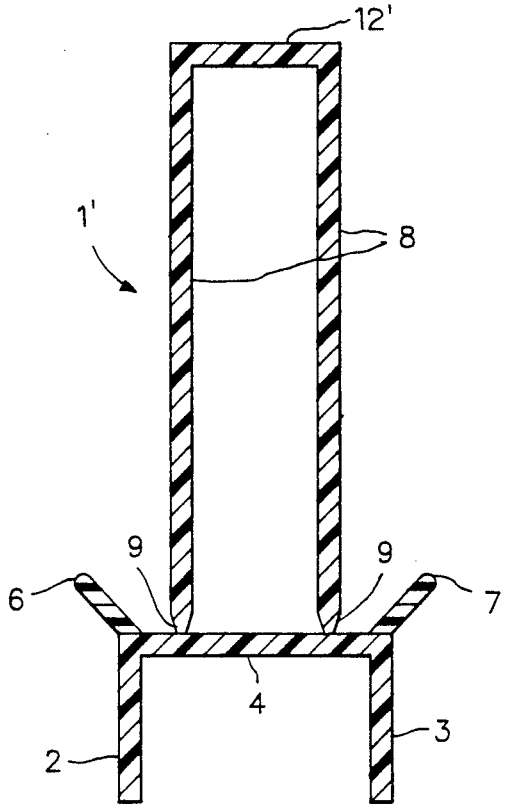
FIG. 3 is a transverse cross-sectional view of a joint member according to another embodiment of the invention.

Also provided are seal members and these may take the form of a pair of outwardly extending ribs or flanges 6 and 7 which may extend outwardly and upwardly as shown in FIGS. 1 and 3. These are made of a more resilient material so that in use they bear against the faces of the slot, groove, or channel as will be described further hereinafter.

In one preferred form of the construction the joint member 1 above described may be formed by a single extruded member, but the material of the ribs 6 and 7 is substantially softer or more resilient than the material from which the remainder of the construction is made. Thus the remainder of the construction may be formed for example from a rigid PVC material having a hardness for example of the order of Shore D80 and a flexible material in the ribs may have a hardness of the order of Shore A60. The color is not essential but may be for example white or grey particularly to provide a neutral color where visible in use in a concrete floor.

In use the system has been devised to be applied to conventional joints or saw cuts from for example 6 mm in width and upwards, with a minimum depth of 30 mm. The majority of industrial floor joint widths fall within the range of 6 to 10 mm, but the system described herein can be extended in principle to much larger joint widths especially in repair situations. Thus, in a cementitious floor 10 a saw cut is formed in for example the known manner.

The channel, groove, or slot 11 so formed is then 25 thoroughly cleaned by use for example of a vacuum and/or compressed air to remove any dust and the joint should be cleaned, dried, free from laitance, loose material, rust, scale, or grease. A joint member 1 according to the embodiment of FIGS. 1 and 2 appropriate to the groove size 15 is then selected and placed into position with the extrusion central and parallel in the slot, channel, or groove 11, and so that the top end 12 of the plate 5 is as close to flush with the concrete surface 13 as is practical. Again, the part of the slot, channel, or groove 11 above the seal members 6 and 7 should be cleaned if necessary and then a filling material is prepared to fill the gaps 14 and 15 on each side of the dividing plate 5. A suitable filler is an epoxy sealant such as a general purpose pourable grout such as a two part, silica sand filled epoxy resin based, high strength, mortar grout. Desirable strengths are such that the tensile strengths lies in the range of 20 to 25N/mm2, the compressive strength lies in the range of 90 to loon/mm2 and the epoxy when filled as shown at 16 and 17 into the groves 14 and 15 is then allow to cure.

Full curing may take about seven days at 25° C. Initial 20 cure for light traffic is 12 hours. Again the filler can be colored to suit the situation. The epoxy sealants of this type have a density of the order of 1.9 g/cm3, a minimum pot life of about 30 minutes @25° C. and provide good chemical resistance to common acids, alkalis and solvents. It is desirable that the epoxy be finished flush with no slumping and the joint is then cleaned up and any masking tape and excess material removed.

Figure 4:
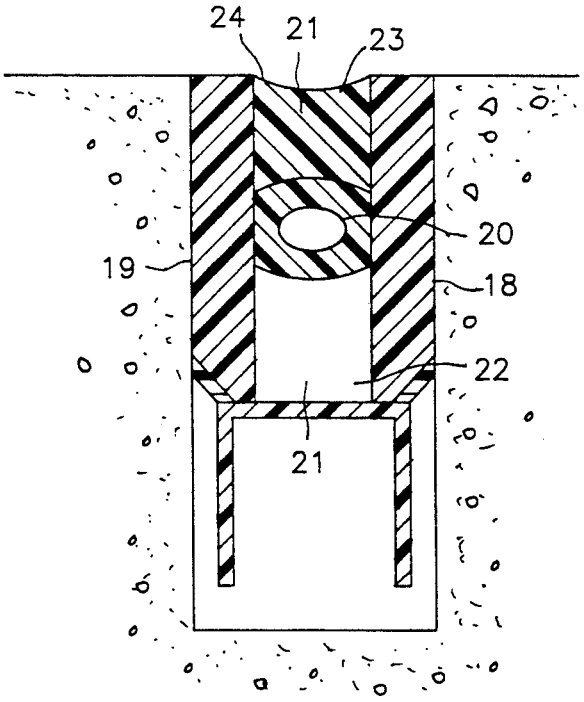
FIG. 4 is a cross-sectional view of the member of FIG. 3 in use.

In another preferred embodiment of the invention shown in FIGS. 3 and 4 the joint member 1' is inserted in a slot, channel, or groove 11 as previously described. The gaps 18 and 19 on either side adjacent the inverted U-shaped member 8 are then filled with epoxy sealant or the like as previously detailed. Once the sealant is substantially cured the inverted U-shaped member 8 is removed. This is possible because of the weakness at attachment points 9. A backing rod 20 is then preferably inserted in the cavity 21 formed where the inverted U-shaped member 8 originally was positioned. The backing rod 20 may be comprised of substantially compressible material such as foam or the like so that it does not drop to the bottom 22 of the cavity 21 but stays in a central position in the cavity 21 due to compressing forces for example. The backing rod 20 is preferably tubular in cross section. The cavity 23 above the backing rod 20 is then filled with a suitable sealant. In one preferred form of the invention sealants such as THIOFLEX 600, EUROFLEX and FILAFLEX BNC, all approved for use in food preparation areas, may be used to fill the cavity 23. Other equivalent materials may be used. In this preferred form of the invention the surface above the sealant in the cavity 23 is of concave dimensions as shown at 24. This is advantageous as it enables a substantial amount of stretch in the joint.

Figure 2:
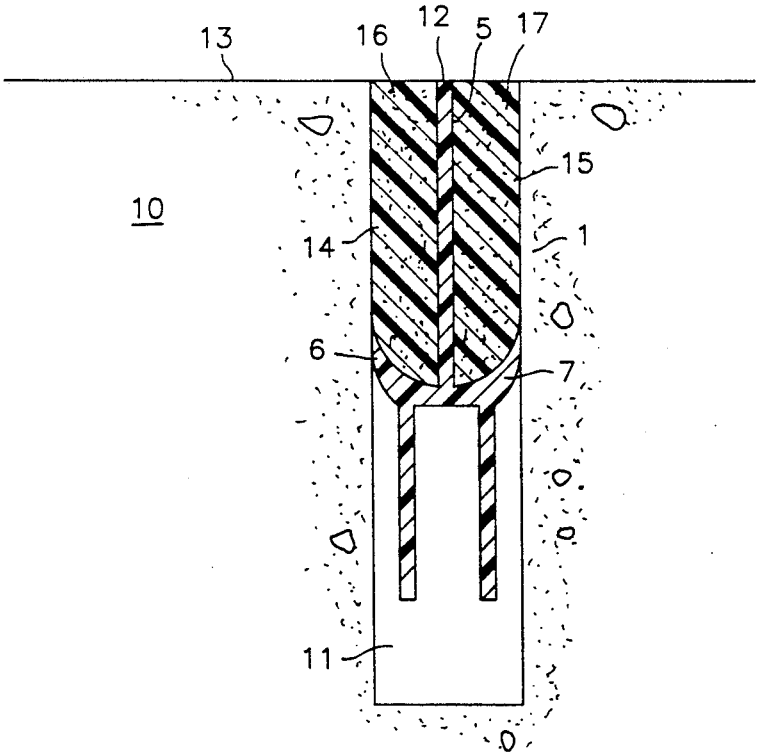
FIG. 2 is a cross-sectional view of the member of FIG. 1 in use.

It will be found that the cured epoxy described herein will have excellent adherence to concrete or cementitious surfaces and little adherence to the PVC in one preferred embodiment of the invention shown in FIGS. 1 and 2. Consequently when and if the joint opens under shrinkage or temperature movement, the joint will open along the line of the rigid PVC strip leaving an epoxy nosing on each concrete edge, providing support and wear resistance when required.

If the joint is subject to any compressive forces, the strength of the epoxy is such as to distribute any likely forces through the cementitious slab in the manner that mortar joints have in the past The shape of the joint member 1 shown in FIGS. 1 and 2 enables the fixing of epoxy nosings, of sufficient depth, on the edges of slab joints, to minimize damage from traffic over the joint. It is possible to provide joint members suitable for various saw cut widths and the particular construction shown in the drawings copes with variation of width in a single saw cut. The construction will seal the slot, channel, or groove to retain the fluid epoxy without substantial slumping and the stabilizing parts of the construction provide a self centering or easily centered construction so that the upper divider 5 is substantially symmetrical. The flexible sealing members 6 and 7 also play a role in these parts.

In the preferred embodiment of FIGS. 3 and 4 a joint member 1 and resultant joint is provided which is particularly designed for use in food preparation areas. In this preferred form of the invention no exposed gap can form at or near the joint as the joint is completely sealed as is the requirement in these areas. The use of suitable sealants in the cavity 23 between the epoxy nosings 18 and 19 ensures that the joint will pass health regulation standards and will distribute compressive or other forces.

Thus t can be seen that at least in the preferred form of the invention a joint member and/or a seal method of forming a joint are provided which will obviate or minimize the disadvantages found with present methods of sealing joints in concrete floors or the like. It will be apparent that the joint member will have other uses of a similar nature.

We claim:

1. A method of providing nosings along cementitious opposing faces each having an exposed edge comprising:

positioning and supporting an elongate divider plate means between said faces;

inserting settable material between said divider plate means and said faces, said settable material adhering to said faces but not adhering to said divider plate when set, and having a high tensile strength and a high compressive strength when set for protecting said faces and said edges from mechanical degradation in normal use; and allowing said settable material to set.

2. A method as claimed in claim 1 wherein said settable material has a tensile strength in the range between approximately 20 and 25N/mm$^2$ when set.

3. A method as claimed in claim 1 wherein said settable material has compressive strength in the range between approximately 90 and 100N/mm$^2$ when set.

4. A method as claimed in claim 1 wherein said settable material comprises a material selected from the group consisting of epoxy resin, material containing silica sand, and mixtures thereof.

5. A method as claimed in claim 1 wherein said settable material has a density of approximately 1 g/cm$^3$ when set.

6. A method as claimed in claim 1 wherein said divider plate means is formed from a rigid plastic material having a hardness of approximately Shore D80.

7. A method as claimed in claim 1 and further comprising:

providing on said divider plate means a base, an upright divider member attached to said base, and seal members; and said positioning step comprises inserting said divider plate means between said faces so that said seal members engage said faces and support said divider plate means in use.

8. A method as claimed in claim 7 and further comprising:

stabilizing said divider plate means to ensure that said divider plate means is in a desired orientation when said divider plate means is positioned between said faces.

9. A method as claimed in claim 8 wherein said stabilizing comprises providing a pair of parallel plates attached to and extending downwardly from said base.

10. A method as claimed in claim 7 wherein said seal members are attached to and extend upwardly from said base.

11. A method as claimed in claim 7 comprising:

inserting said settable material above said seal members.

12. A method as claimed in claim 7 wherein said upright divider member comprises a planar head member and a pair of parallel spaced planar side members extending downwardly from said head member forming a cavity between said planar side members.

13. A method as claimed in claim 12 and further comprising:

detaching said upright divider member from said base when said settable material has substantially set thereby providing a cavity between said settable material adhering to said faces.

14. A method as claimed in claim 13 and further comprising:

inserting a backing rod in said cavity between said settable material adhering to said faces after detaching said upright divider member from said base so that said backing rod bears against, and is held in place between, said settable material adhering to said faces.

15. A method as claimed in claim 14 and further comprising:

inserting a second settable material in said cavity between said first mentioned settable material above said backing rod.

16. A method as claimed in claim 15 wherein said second settable material is substantially resilient.

17. Nosings provided along cementitious opposing faces of a slot, channel or groove, each face having an upper edge, comprising:

a divider plate means between said opposing faces; and filling material set in situ between said divider plate means and said opposing faces and adhering to said opposing faces, but not adhering to said divider plate means;

said set material having a high tensile strength and a high compressive strength for substantially protecting said opposing faces and said upper edges from mechanical degradation in normal use.

18. Nosings as claimed in claim 17 wherein said set material has a tensile strength in the range between approximately 20 and 25N/mm$^2$.

19. Nosings as claimed in claim 17 wherein said set material has a compressive strength in the range between approximately 90 and 100N/mm$^2$.

20. Nosings as claimed in claim 17 wherein said set material has a density of approximately 1.9 g/cm$^3$.

21. Nosings as claimed in claim 17 wherein said set material comprises a material selected from the group consisting of epoxy resin, material containing silica sand, and mixtures thereof.

22. Nosings as claimed in claim 17 wherein said set divider plate means comprises rigid plastic material having a hardness of approximately Shore D80.

23. Nosings as claimed in claim 17 wherein said divider plate means comprises:

a base;

an upright divider member attached to said base; and seal members attached to said base and engaging said opposing faces for supporting said divider plate means between said opposing faces.

24. Nosings as claimed in claim 23 and further comprising:

stabilizing means on said divider plate means for stabilizing said divider plate means in a desired orientation when positioned between said opposing faces.

25. Nosings as claimed in claim 24 wherein said stabilizing means comprises a pair of parallel plates, attached to, and extending downwardly from said base.

26. Nosings as claimed in claim 23 wherein said seal members are substantially more flexible than said divider member and said base.

27. Nosings as claimed in claim 17 and further comprising:

detachable part on said divider plate means;

a cavity between said set material adhering to said faces produced by removal of said detachable part;

a backing rod positioned in said cavity between and engaging said set material adhering to said faces; and a second set material between and engaging said first mentioned set material above said backing rod.

28. Nosings as claimed in claim 27 wherein said second set material is substantially resilient.

29. A joint member for positioning between cementitious opposing faces of a slot, channel, or groove comprising:

a base;

an upright divider plate attached to said base and having a width substantially less in cross section than said base;

stabilization means attached to said base for retaining said joint member in a desired orientation when said divider plate is positioned between said opposing faces in use; and seal members on said joint member and comprised of material substantially more resilient than said base and said divider plate, and engageable with said opposing faces in use.

30. A joint member as claimed in claim 29 wherein said base and said divider plate comprise a rigid plastic material having a hardness of approximately Shore D80.

31. A joint member as claimed in claim 29 wherein said stabilization means comprises a pair of spaced elongate plates attached to and extending downwardly from said base.

32. A joint member as claimed in claim 29 wherein said divider plate comprises:

a head portion;

a pair of parallel planar members extending downwardly from said head portion; and a cavity between said parallel planar members.

33. A joint member as claimed in claim 32 wherein said divider plate is detachable from said base.

34. A joint member as claimed in claim 29 wherein said seal members are attached to and extend upwardly from said base.

35. A joint member as claimed in claim 29 wherein said seal members are substantially flexible and have a hardness of approximately Shore D60.

* * * * *